US011760099B2

(12) United States Patent
Maeshima

(10) Patent No.: US 11,760,099 B2
(45) Date of Patent: Sep. 19, 2023

(54) INK-JET RECORDING APPARATUS

(71) Applicant: KYOCERA Document Solutions Inc., Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 71 days.

(21) Appl. No.: 17/699,938

(22) Filed: Mar. 21, 2022

(65) Prior Publication Data

US 2022/0339940 A1 Oct. 27, 2022

(30) Foreign Application Priority Data

Apr. 27, 2021 (JP) ..... 2021-074931

(51) Int. Cl.
*B41J 2/175* (2006.01)

(52) U.S. Cl.
CPC ..... *B41J 2/175* (2013.01)

(58) Field of Classification Search
CPC ..... B41J 2/175; B41J 2/17566; B41J 2002/17576
See application file for complete search history.

(56) References Cited

U.S. PATENT DOCUMENTS 9,738,087 B2 * 8/2017 Kato ..... B41J 2/175
11,077,670 B2 * 8/2021 Danzuka ..... B41J 2/19

FOREIGN PATENT DOCUMENTS

JP 2001-10075 A 1/2001

* cited by examiner

*Primary Examiner* — An H Do
(74) *Attorney, Agent, or Firm* — Stein IP, LLC

(57) ABSTRACT

An ink-jet recording apparatus includes a sub tank that pools an ink supplied from a container, a recording head, a heater, a temperature sensor, and a control unit that supplies the ink from the container to the sub tank when an allowed state has been established. The control unit determines that the allowed state has been established when the temperature of the sub tank is equal to or higher than a tank control temperature. The sub tank has a capacity that is higher than the capacity per container.

6 Claims, 7 Drawing Sheets

INK-JET RECORDING APPARATUS

INCORPORATION BY REFERENCE

This application is based on and claims the benefit of priority from Japanese Patent Application No. 2021-074931 filed on Apr. 27, 2021, the contents of which are hereby incorporated by reference.

BACKGROUND

The present disclosure relates to an ink-jet recording apparatus.

Known ink-jet recording apparatuses include recording heads that eject inks onto sheets. In addition, the known ink-jet recording apparatuses also include sub tanks that are connected to the recording heads. The sub tanks are connected to containers that contain inks for replenishment. The sub tanks pool the inks supplied from the containers. Then, the recording heads eject the inks supplied from the sub tanks.

SUMMARY

According to an aspect of the present disclosure, there is provided an ink-jet recording apparatus to which a container that contains an ink is mounted, the ink-jet recording apparatus including a sub tank, a recording head, a heater, a temperature sensor, and a control unit. The sub tank pools the ink supplied from the container. The recording head ejects the ink supplied from the sub tank onto a sheet. The heater maintains the temperature of the sub tank at a preset tank-control temperature. The temperature sensor outputs a value in accordance with the temperature of the sub tank. The control unit determines whether or not an allowed state has been established, and supplies the ink from the container to the sub tank when the allowed state has been established. The control unit detects the temperature of the sub tank on the basis of the output value from the temperature sensor. The control unit determines that the allowed state has been established when the temperature of the sub tank is equal to or higher than the preset tank-control temperature. The sub tank has a capacity that is higher than the capacity per container.

DETAILED DESCRIPTION

Hereinbelow, an ink-jet recording apparatus according to an embodiment of the present disclosure is described by way of an example of a printer of an ink-jet recoding type.

(Overall Configuration of Ink-Jet Recording Apparatus)

Figure 1:
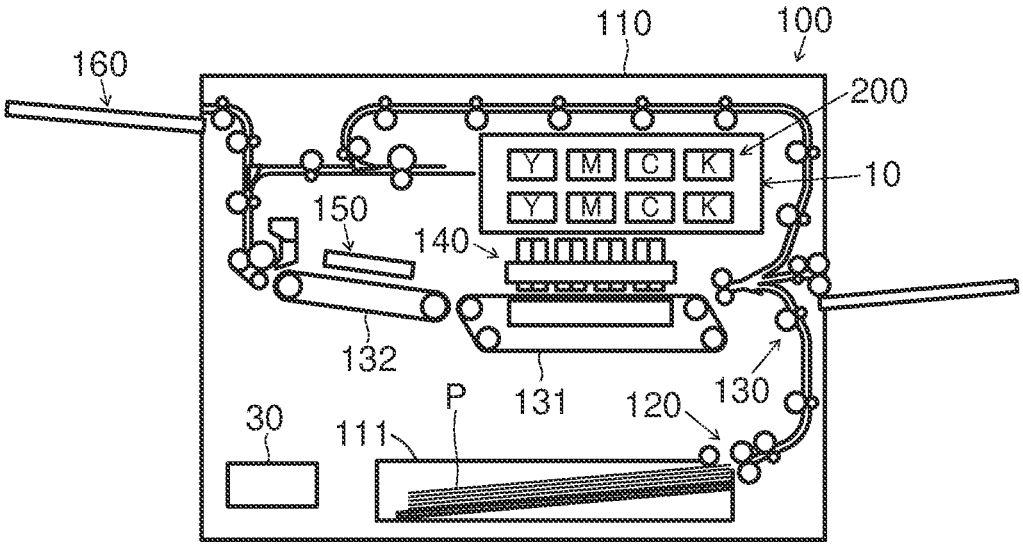
FIG. 1 is an overall schematic view of an ink-jet recording apparatus according to an embodiment of the present disclosure.

As illustrated in FIG. 1, an ink-jet recording apparatus 100 includes an apparatus body 110. The ink-jet recording apparatus 100 includes a sheet feeding section 120, a conveying section 130, a recording section 140, a drying section 150, and a delivery section 160 in the apparatus body 110.

A sheet feeding cassette 111 is set in the apparatus body 110. The sheet feeding cassette 111 houses paper P. The paper P corresponds to "sheets." In print jobs by the ink-jet recording apparatus 100, images are printed onto the paper P.

The sheet feeding section 120 separates the paper P in the sheet feeding cassette 111 one by one, and then feeds the paper P to the conveying section 130. The conveying section 130 conveys the paper P fed from the sheet feeding section 120. The paper P fed from the sheet feeding section 120 passes through the recording section 140 and the drying section 150 in this order, and then is delivered into the delivery section 160.

The conveying section 130 includes a first belt-conveyor unit 131 and a second belt-conveyor unit 132. The first belt-conveyor unit 131 and the second belt-conveyor unit 132 each include an endless conveyor belt. The first belt-conveyor unit 131 and the second belt-conveyor unit 132 each suck and hold the paper P on an outer peripheral surface of the conveyor belt.

The conveyor belt is stretched around stretching rollers. The stretching rollers are supported to be rotatable. In conjunction with rotation of the stretching rollers, the conveyor belt circles. In other words, in conjunction with the rotation of the stretching rollers, the paper P on the conveyor belt is conveyed.

The recording section 140 is arranged above the first belt-conveyor unit 131. Under the state in which the paper P is sucked and held on the conveyor belt, the paper P on the conveyor belt and the recording section 140 face each other with a clearance therebetween.

Figure 2:
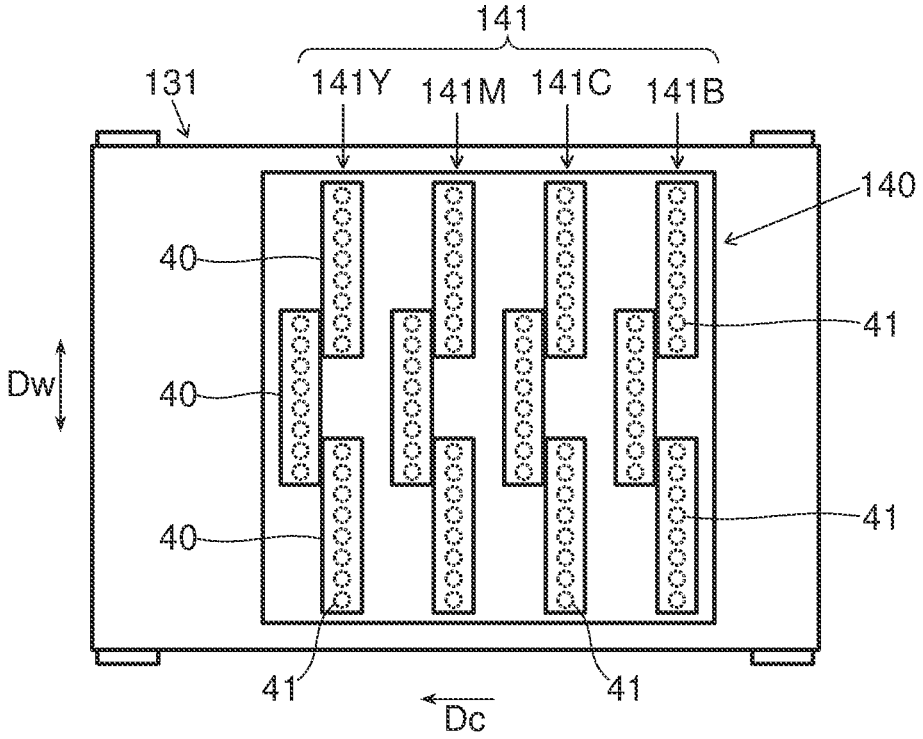
FIG. 2 is a plan view of a recording section of the ink-jet recording apparatus according to the embodiment.

The recording section 140 includes four line heads 141 corresponding respectively to colors of cyan, magenta, yellow, and black (refer to FIG. 2). In other words, the ink-jet recording apparatus 100 is a color printer. In the following description, the four line heads 141 may be distinguished from each other by adding a suffix "C" to a cyan line head 141, a suffix "M" to a magenta line head 141, a suffix "Y" to a yellow line head 141, and a suffix "K" to a black line head 141.

As illustrated in FIG. 2, the line heads 141 corresponding respectively to these colors each include a plurality of (for example, three) recording heads 40. The plurality of recording heads 40 corresponding respectively to these colors are arranged, for example, in a staggered pattern in a document width direction Dw that is orthogonal to a document conveying direction Dc.

The recording heads 40 each have, as a nozzle surface, a surface that faces the conveyor belt of the first belt-conveyor unit 131 (faces the paper P on this conveyor belt). The nozzle surface of each of the recording heads 40 includes a plurality of nozzles 41. The plurality of nozzles 41 of each of the recording heads 40 are arrayed along the document width direction Dw. The plurality of nozzles 41 of each of the recording heads 40 eject an ink in a corresponding one of the colors onto the paper P. In FIG. 2, the nozzles 41 are indicated by dotted lines. The nozzles 41 to be actually provided in each of the recording heads 40 are larger in number than those in the illustration.

The recording section 140 ejects the inks onto the paper P in accordance with image data to be printed in the print job. The inks ejected from the recording section 140 (recording heads 40) adhere to the paper P. In this way, the images are formed on the paper P.

In addition, as illustrated in FIG. 1, the drying section 150 is arranged in a periphery of the second belt-conveyor unit 132. The drying section 150 blows air onto the conveyor belt of the second belt-conveyor unit 132. With this, the inks adhering to the paper P on the conveyor belt are dried.

The delivery section 160 includes a tray on which the paper P is stacked. In the print job, the printed paper P (paper P to which the inks have adhered) are delivered into the delivery section 160.

The inks are consumed by performing the print job. Thus, the ink-jet recording apparatus 100 includes a mount unit 10. Containers 200 are mounted to the mount unit 10. The containers 200 contain inks for replenishment. When the inks are consumed in the print job, the inks are supplied from the containers 200 to the recording section 140 (recording heads 40).

The ink-jet recording apparatus 100 is a color printer. Thus, the containers 200 mounted to the mount unit 10 correspond to the four colors. In the following description, the four containers 200 may be distinguished from each other by adding the suffix "C" to a container 200 that contains a cyan ink, the suffix "M" to a container 200 that contains a magenta ink, the suffix "Y" to a container 200 that contains a yellow ink, and the suffix "K" to a container 200 that contains a black ink.

The containers 200 are detachable. In other words, the containers 200 are replaceable. When any of the containers 200 has been emptied, the emptied one of the containers 200 is replaced with a new container 200 (container 200 filled with an ink in the corresponding color).

Note that, the containers 200 mounted to the mount unit 10 may each include a plurality of containers 200 that contain an ink in the same color. For example, the container 200C corresponding to cyan, the container 200M corresponding to magenta, the container 200Y corresponding to yellow, and the container 200K corresponding to black to be mounted to the mount unit 10 respectively include a plurality of containers 200C corresponding to cyan, a plurality of containers 200M corresponding to magenta, a plurality of containers 200Y corresponding to yellow, and a plurality of containers 200K corresponding to black. The numbers of the containers 200 corresponding to the respective colors are the same as each other, that is, two.

In a configuration in which a plurality of containers 200 that contain the ink in the same color are mounted, even when any of the containers 200 has been emptied, the emptied one of the containers 200 need not be immediately replaced because another container 200 that contains the ink in the same color as that in the emptied container 200 is mounted. In other words, even under the state in which any of the containers 200 has been emptied, the ink-jet recording apparatus 100 can be used even without a spare container 200 that contains the ink in the same color as that in the emptied container 200. With this, convenience of users is increased.

In addition, the ink-jet recording apparatus 100 includes a control unit 30. Although not shown, the control unit 30 includes various electronic devices such as a CPU, an ASIC, and memories. These electronic devices are mounted to a substrate. The memories are, for example, a ROM and a RAM. The memories store control programs and control data. The control unit 30 executes processes relating to the print jobs in accordance with the control programs and the control data.

(Ink Supply Mechanism)

Figure 3:
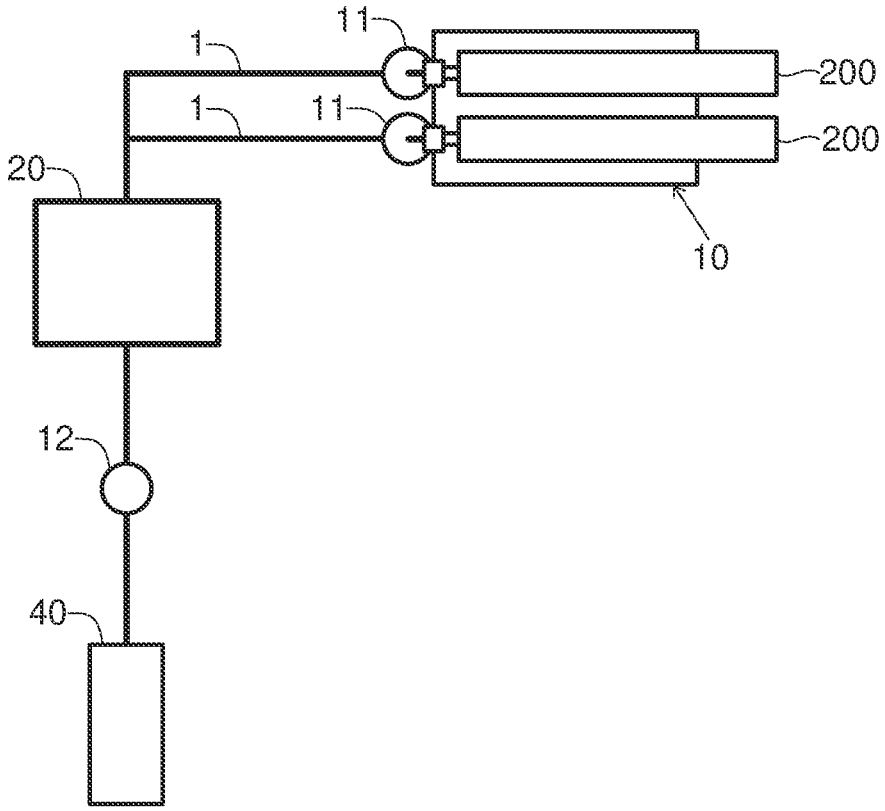
FIG. 3 is a schematic diagram of an ink supply mechanism of the ink-jet recording apparatus according to the embodiment.

As shown in FIG. 3, by mounting the containers 200 to the mount unit 10, supply tubes 1 can be connected to the containers 200. The containers 200 are connected to the recording head 40 via the supply tubes 1. The inks in the containers 200 are supplied to the recording head 40 through the supply tubes 1. Hereinbelow, details of this mechanism that supplies the inks from the containers 200 to the recording head 40 are described.

Note that, the ink supply mechanisms for the different colors are the same as each other. Thus, for the sake of convenience, only one of the ink supply mechanisms, the one corresponding to one of the colors (two containers 200 that contain an ink in the same color), is shown in FIG. 3. Hereinbelow, the following description of the one of the ink supply mechanisms, the one corresponding one color, is applied to the other ones of the ink supply mechanisms, and the other ones of the ink supply mechanisms are not described.

The ink supply mechanism includes suction pumps 11. Diaphragm pumps, syringe pumps, tube pumps, or the like may be used as the suction pumps 11. The suction pumps 11 are assigned on a one-to-one basis to the containers 200. The plurality of containers 200 that contain the ink in the same color are connected respectively to corresponding ones of the suction pumps 11.

The ink supply mechanism includes a sub tank 20. On an ink supply path, the sub tank 20 is arranged between the containers 200 and the recording head 40, downstream of the suction pumps 11. The sub tank 20 is assigned one to each color.

The plurality of containers 200 that contain the ink in the same color are connected to the sub tank 20 for the corresponding color via the supply tubes 1. In other words, the supply tubes 1 connected respectively to the plurality of containers 200 that contain the ink in the same color are connected to the same sub tank 20.

The suction pumps 11 suck the ink from the containers 200, and supply the ink to the sub tank 20. The sub tank 20 temporarily pools the ink. Then, hydraulic head pressure is generated to cause the ink in the sub tank 20 to be supplied to the recording head 40 corresponding to the corresponding color.

Note that, a capacity of the sub tank 20, that is, an amount of the ink that can be pooled in the sub tank 20 is larger than a capacity of each one of the containers 200. Thus, the ink can be temporarily pooled in the sub tank 20 in an amount larger than an amount of the ink in each one of the containers 200. With this, even in a case where a print job in which the ink is consumed in a large amount within a short time period is performed, the sub tank 20 can be suppressed from being emptied. In other words, interruption of the print job due to ink depletion can be suppressed.

The capacity of the sub tank 20, which is higher than the capacity of each one of the containers 200, is, for example, lower than a capacity of two of the containers 200. Note that, the capacity of the sub tank 20 may be changed in accordance with specifications of the ink-jet recording apparatus 100, specifically, may be equal to or higher than the capacity of two of the containers 200.

The ink supply mechanism includes a purge pump 12. The diaphragm pump, the syringe pump, the tube pump, or the like may be used as the purge pump 12. The purge pump 12 is assigned one to each of the sub tanks 20. The purge pump 12 is used in a purge process. The purge process is a process of discharging the ink in the sub tank 20 to the recording head 40, and forcibly purging the ink through the nozzles 41. By executing the purge process, clogging of the nozzles 41 can be suppressed.

(Tank-Temperature Maintenance Process)

Figure 4:
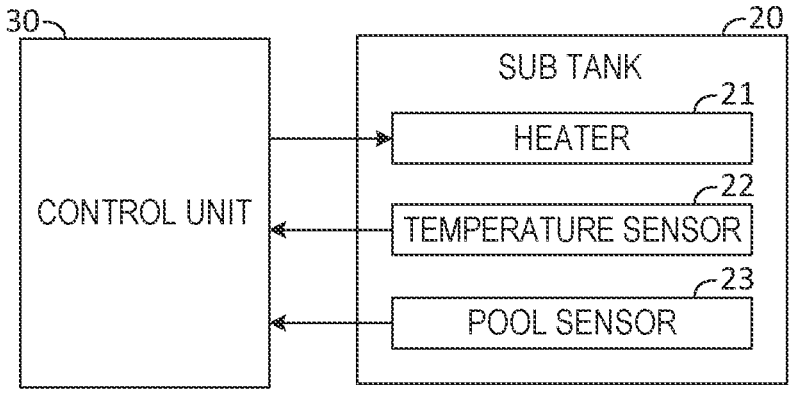
FIG. 4 is a block diagram relating to a temperature maintenance process executed in the ink-jet recording apparatus according to the embodiment.

The processes relating to the print jobs include a tank-temperature maintenance process of heating the ink in the sub tank 20. As shown in FIG. 4, in order that the tank-temperature maintenance process is executed, the ink-jet recording apparatus 100 includes a heater 21 and a temperature sensor 22. The tank-temperature maintenance process is executed by the control unit 30.

For example, both the heater 21 and the temperature sensor 22 are provided for each of the sub tanks 20. In addition, the heater 21 is provided so as to face a part of an outer side surface of the sub tank 20. The temperature sensor 22 is arranged to face the heater 21 across the sub tank 20. Note that, for the sake of convenience, only the sub tank 20, the heater 21, and the temperature sensor 22 corresponding to one color are shown in FIG. 4.

The heater 21 heats the sub tank 20 to maintain a temperature of the sub tank 20 at a preset tank-control temperature. The temperature sensor 22 outputs values in accordance with the temperature of the sub tank 20. Note that, by heating the sub tank 20, the ink pooled in the sub tank 20 is heated. As the temperature of the sub tank 20 becomes higher, a temperature of the ink pooled in the sub tank 20 becomes higher. As the temperature of the sub tank 20 becomes lower, the temperature of the ink pooled in the sub tank 20 becomes lower. In other words, the temperature sensor 22 outputs values in accordance with the temperature of the ink pooled in the sub tank 20.

The control unit 30 controls and drives the heater 21. Specifically, the control unit 30 controls ON/OFF of energization of the heater 21. Further, the control unit 30 detects the temperature of the sub tank 20 on the basis of the output values from the temperature sensor 22.

Still further, in accordance with the temperature of the sub tank 20, the control unit 30 switches whether or not to cause the heater 21 to heat the sub tank 20. In this way, the control unit 30 maintains the temperature of the sub tank 20 at the tank control temperature. In other words, the control unit 30 executes the tank-temperature maintenance process. Note that, the control unit 30 executes the tank-temperature maintenance process with respect to each of the sub tanks 20.

Although not shown, the recording head 40 is provided with a head heater and a head temperature sensor. On the basis of output values from the head temperature sensor, the control unit 30 detects a temperature of the recording head 40, that is, a temperature of the ink supplied in the recording head 40. In addition, the control unit 30 controls and drives the head heater so as to maintain the temperature of the recording head 40 (temperature of the ink supplied in the recording head 40) at a preset head-control temperature. In this configuration, the tank control temperature is set to be equal to the head control temperature.

By heating the ink in the recording head 40, ink ejection failures that may occur depending on the temperature of the ink can be suppressed. However, in the print job in which the ink is consumed in a large amount within a short time period, the ink in the recording head 40 may not be sufficiently heated. As a countermeasure, the tank-temperature maintenance process is executed. By executing the tank-temperature maintenance process, the ink that is heated in the sub tank 20 is supplied to the recording head 40. As a result, the occurrence of the ink ejection failures in the recording head 40 can be suppressed.

(Ink Supply Process)

The processes relating to the print jobs also include an ink supply process of supplying the ink from the containers 200 to the sub tank 20. As shown in FIG. 4, in order that the ink supply process is executed, the ink-jet recording apparatus 100 includes a pool sensor 23. The ink supply process is executed by the control unit 30.

The pool sensor 23 is provided for each of the sub tanks 20. The pool sensor 23 is a sensor for detecting a level of the ink (that is, liquid) pooled in the corresponding sub tank 20. This sensor is referred, for example, to as a level sensor. The pool sensor 23 includes a lower-limit switch and an upper-limit switch.

The lower-limit switch varies its output values when the level of the ink pooled in the sub tank 20 becomes lower than a preset lower-limit position. The lower-limit position is set at a level under a state in which the ink is pooled in an appropriate amount in the sub tank 20. In other words, the lower-limit switch varies its output values when an amount of the ink pooled in the sub tank 20 becomes smaller than a preset appropriate pooled amount. The upper-limit switch varies its output values when the level of the ink pooled in the sub tank 20 becomes higher than a preset upper-limit position. The upper-limit position is set at a level under a state in which the amount of the ink pooled in the sub tank 20 is somewhat larger than the appropriate amount (amount corresponding to the lower-limit position).

The control unit 30 detects the level of the ink pooled in the sub tank 20 on the basis of the output values from the pool sensor 23. In other words, the control unit 30 detects the amount of the ink pooled in the sub tank 20 on the basis of the output values from the pool sensor 23. Then, the control unit 30 executes the ink supply process on the basis of the amount of the ink pooled in the sub tank 20.

Note that, the ink in the sub tank 20 is supplied to the recording head 40. The ink in the recording head 40 is consumed by performing the print job. Thus, the ink supply process by the control unit 30 continues to be executed at least while the print job is being performed.

The control unit 30 executes the ink supply process with respect to each of the colors. In other words, a frequency of ink supply differs from color to color. In addition, the frequency of the ink supply varies depending on contents of the images to be printed.

When any of the amounts of the inks pooled in the sub tanks 20 becomes smaller than the appropriate pooled amount, the control unit 30 drives the suction pumps 11 connected to the corresponding sub tank 20. With this, the ink is supplied from the containers 200 to the sub tank 20 in which the amount of the pooled ink has become smaller than the appropriate pooled amount. Note that, even when any of the amounts of the inks pooled in the sub tanks 20 becomes smaller than the appropriate pooled amount, the ink supply to the sub tank 20 may not be immediately started. A timing of starting the ink supply is described in detail below.

After the start of the ink supply, the control unit 30 determines whether or not the level in the sub tank 20 as a destination of the ink supply has reached the upper-limit position. When the level in the sub tank 20 as the destination of the ink supply has reached the upper-limit position, the control unit 30 stops the ink supply. Note that, in a case where the level in the sub tank 20 as the destination of the ink supply has not reached the upper-limit position even after a lapse of a preset time period since the start of the ink supply, the control unit 30 determines that one of the containers 200 as a source of the ink supply has been emptied.

When any of the containers 200 has been emptied, the control unit 30 executes a notification process of notifying that that container 200 needs to be replaced. For example, a notification message is displayed on a display input apparatus (not shown) that is communicably connected to the ink-jet recording apparatus 100. The notification message includes information about the emptied container 200 (such as a color of the ink and a model). The display input apparatus to display the notification message is an operation panel, a personal computer, or the like. When such a notification process is executed, the user replaces the emptied container 200 with the new container 200 (container 200 filled with the ink in a corresponding color).

Note that, the control unit 30 executes a supply-source setting process of setting a container 200 to be used in the print job among the plurality of containers 200 that contain the ink in the same color (container 200 to serve as the ink supply source for the sub tank 20). The control unit 30 executes the supply-source setting process with respect to each of the colors. In other words, one of the containers 200 corresponding to each color is set as the ink supply source.

For example, the control unit 30 causes the memories to store supply-source information indicating which of the containers 200 corresponding to each color has been set as the ink supply source. Then, in performing the print job, the control unit 30 sets, with respect to each of the colors, a container 200 indicated by the supply source information among the plurality of containers 200 as the ink supply source. When any of the sub tanks 20 needs the ink supply, the control unit 30 recognizes the container 200 that has been set as the ink supply source among the plurality of containers 200 that contain the ink in the same color as that of the ink in the sub tank 20 that needs the ink supply. Then, the control unit 30 causes the recognized container 200 to supply the ink.

Note that, the control unit 30 does not change the ink supply source until the container 200 as the ink supply source is emptied. When the container 200 that has been set as the ink supply source is emptied, the control unit 30 sets a remaining one of the containers 200 as a new ink-supply source, the remaining one containing the ink in the same color as that of the ink in the emptied container 200 as the previous ink-supply source. In this configuration, even when the container 200 as the ink supply source is emptied, since the remaining one container 200 that contains the ink in the same color as that of the ink in the emptied container 200 as the previous ink-supply source is reserved in the filled state, this filled container 200 is set as the new ink-supply source. With this, the print job is not interrupted, which provides a convenience of promptly completing the print job to the user.

(Supply Start Timing)

From a start to the completion of the print job, the control unit 30 continues to determine whether or not an allowed state has been established. Note that, the allowed state is a state in which the ink supply from the containers 200 to the sub tank 20 is allowed. Not only on the basis of the amount of the ink pooled in the sub tank 20 (remaining amount of the ink), but also on the basis of whether or not the allowed state has been established, the control unit 30 controls a timing at which the ink supply from the containers 200 to the sub tank 20 is started.

Specifically, the control unit 30 detects the temperature of the sub tank 20 on the basis of the output values from the temperature sensor 22. Further, the control unit 30 determines whether or not the temperature of the sub tank 20 is equal to or higher than the tank control temperature. As a result, when the temperature of the sub tank 20 is equal to or higher than the tank control temperature, the control unit 30 determines that the allowed state has been established. Still further, the control unit 30 performs the ink supply from the containers 200 to the sub tank 20 under the state in which the allowed state has been established. In other words, unless the allowed state has been established, the ink supply from the containers 200 to the sub tank 20 is not performed.

In this configuration, the temperatures of the ink supplied from the containers 200 can be maintained at a constant level. In other words, the temperatures of the ink supplied from the sub tank 20 to the recording head 40 can be maintained at a constant level. With this, variation in temperature of the ink in the recording head 40 (decrease in temperature of the ink in the recording head 40) can be reliably suppressed.

In addition, since the capacity of the sub tank 20 is higher than the capacity of each one of the containers 200, the ink can be pooled in a large amount in the sub tank 20. With this, in a time period from the start to the completion of the print job, the ink supply from the containers 200 to the sub tank 20 can be suppressed from being frequently performed. Thus, the temperature of the sub tank 20 is prevented from decreasing. As a result, reliability of suppressing the variation in temperature of the ink in the recording head 40 can be increased.

Note that, while the print job is being performed, the control unit 30 detects the temperature of the recording head 40 (temperature of the ink supplied in the recording head 40). In addition, in order that quality of the images is maintained, when the temperature of the recording head 40 becomes lower than a preset threshold, the control unit 30 interrupts the print job. In this configuration, if the variation in temperature of the ink in the recording head 40 can be suppressed (if the decrease in temperature of the ink in the recording head 40 can be suppressed), the print-job interruption that may occur depending on the temperature of the ink in the recording head 40 is suppressed. If the print job is not interrupted, the print job is promptly completed, which increases a convenience for the user.

In addition, when the variation in temperature of the ink in the recording head 40 is suppressed, variation in viscosity of the ink in the recording head 40 (decrease in viscosity of the ink in the recording head 40) can be suppressed. As a result, image-quality degradation that may be caused by the ink ejection failures can be suppressed.

Note that, the control unit 30 detects the temperatures of the sub tanks 20 corresponding respectively to the colors. In addition, the control unit 30 determines whether or not the allowed state has been established with respect to each of the colors. Thus, there may be a situation in which the allowed state of the supply of an ink in one color may be established, and the allowed state of the supply of another ink in another color may not be established.

Figure 5:
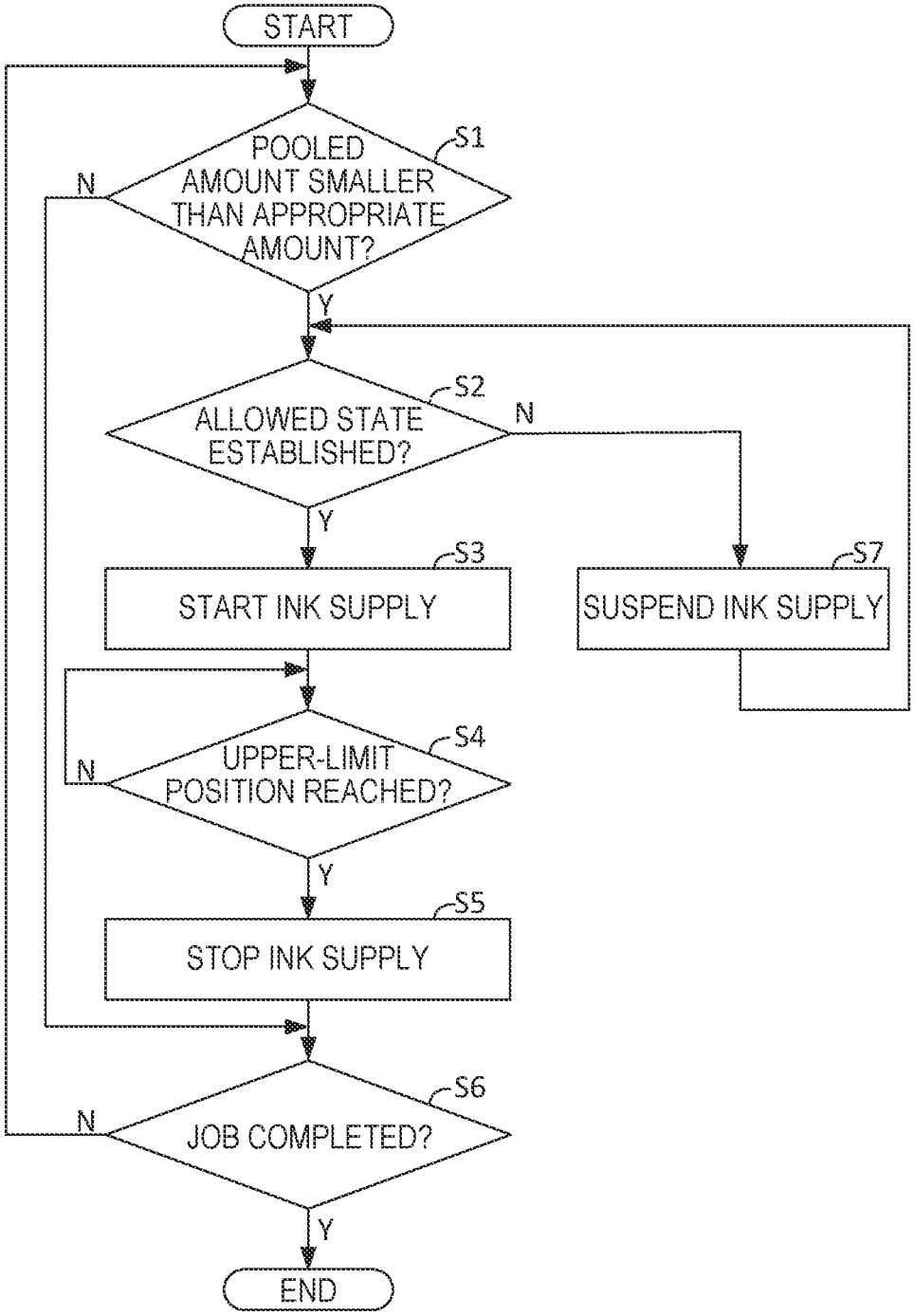
FIG. 5 is a flowchart showing a procedure executed by a control unit of the ink-jet recording apparatus according to the embodiment.

Hereinbelow, with reference to a flowchart shown in FIG. 5, a procedure executed by the control unit 30 after the start of the print job is described. "START" of the procedure shown in FIG. 5 corresponds to a time when the print job is started. Note that, the control unit 30 executes processes in the procedure shown in FIG. 5 with respect to each of the colors.

In Step S1, the control unit 30 determines whether or not the amount of the ink pooled in the sub tank 20 has become smaller than the appropriate pooled amount. If the control unit 30 determines that the amount of the ink pooled in the sub tank 20 has become smaller than the appropriate pooled amount, the procedure proceeds to Step S2.

In Step S2, the control unit 30 determines whether or not the allowed state has been established. In other words, the control unit 30 determines whether or not the ink supply to the sub tank 20 in which the amount of the pooled ink has become smaller than the appropriate pooled amount has been allowed. In still other words, the control unit 30 determines whether or not the temperature of the sub tank 20 in which the amount of the pooled ink has become smaller than the appropriate pooled amount has been equal to or higher than the tank control temperature. If the control unit 30 determines that the allowed state has been established, the procedure proceeds to Step S3.

In Step S3, the control unit 30 starts the ink supply from the containers 200 to the sub tank 20. After the start of the ink supply, the procedure proceeds to Step S4.

In Step S4, the control unit 30 determines whether or not the level of the ink pooled in the sub tank 20 has reached the upper-limit position. If the control unit 30 determines that the level of the ink pooled in the sub tank 20 has reached the upper-limit position, the procedure proceeds to Step S5. If the control unit 30 determines that the level of the ink pooled in the sub tank 20 has not reached the upper-limit position, the determination in Step S4 is repeated. If the procedure proceeds to Step S5, the control unit 30 stops the ink supply.

Note that, in the case where the level of the ink pooled in the sub tank 20 does not reach the upper-limit position even after the lapse of the preset time period since the start of the ink supply, the control unit 30 determines that the container 200 as the ink supply source has been emptied. Even under the state in which the container 200 as the ink supply source has been emptied, the control unit 30 continues the print job. Note that, the control unit 30 sets the remaining one of the containers 200 as the new ink-supply source, the remaining one containing the ink in the same color as that of the ink contained in the emptied container 200.

In Step S6, the control unit 30 determines whether or not the print job has been completed. If the control unit 30 determines that the print job has been completed, the procedure is ended. If the control unit 30 determines that the print job has not been completed, the procedure returns to Step S1.

If the control unit 30 determines in Step S1 that the amount of the ink pooled in the sub tank 20 has not become smaller than the appropriate pooled amount, the procedure proceeds to Step S6. In other words, whether or not the ink supply from the containers 200 to the sub tank 20 is necessary continues to be determined from the start to the completion of the print job, and the ink supply is performed if it is determined that the ink supply is necessary.

If the control unit 30 determines in Step S2 that the allowed state has not been established, the procedure proceeds to Step S7. In Step S7, although the amount of the ink pooled in the sub tank 20 has become smaller than the appropriate pooled amount, the control unit 30 suspends the ink supply from the containers 200 to the sub tank 20. Then, the procedure returns to Step S2. After that, the control unit 30 repeats the determination as to whether or not the allowed state has been established.

In this way, if the allowed state has already been established when the amount of the ink in the sub tank 20 (amount of the ink pooled in the sub tank 20) as detected on the basis of the output values from the pool sensor 23 becomes smaller than the appropriate pooled amount, the control unit 30 supplies the ink from the containers 200 to the sub tank 20. Meanwhile, if the allowed state has not yet been established even when the amount of the ink in the sub tank 20 (amount of the ink pooled in the sub tank 20) as detected on the basis of the output values from the pool sensor 23 becomes smaller than the appropriate pooled amount, the control unit 30 does not supply the ink from the containers 200 to the sub tank 20. With this, while the print job is being performed, the temperature of the ink to be supplied to the recording head 40 can be suppressed from decreasing. As a result, the variation in temperature of the ink in the recording head 40 (variation in viscosity of the ink in the recording head 40) can be suppressed.

(First Modification)

Figure 6:
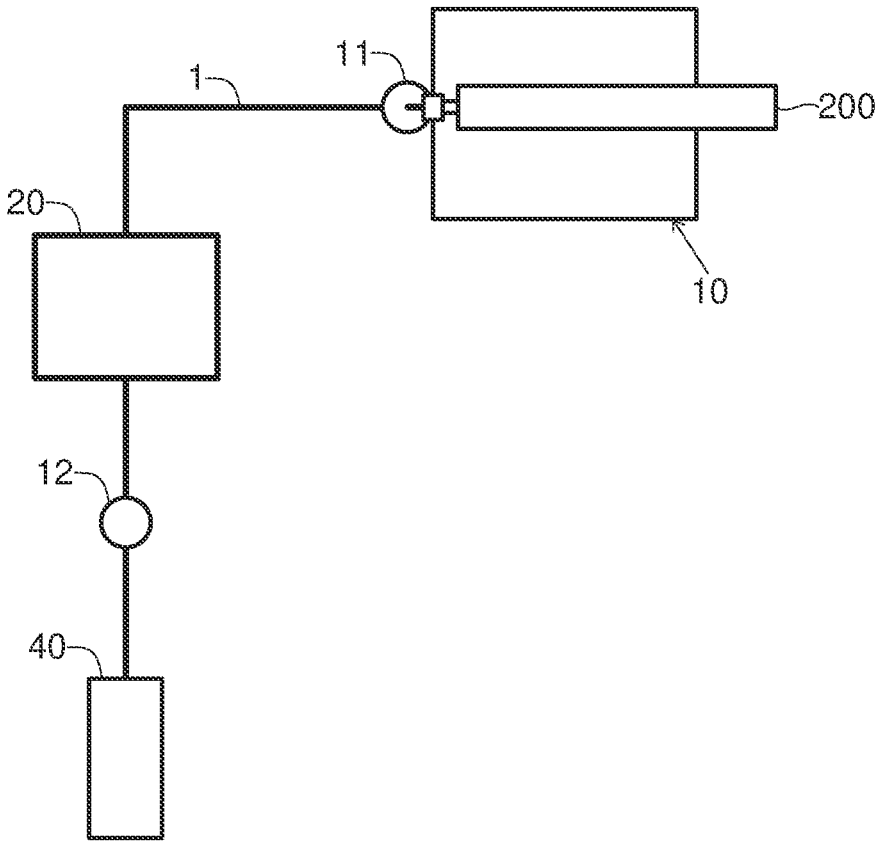
FIG. 6 is a schematic diagram of an ink supply mechanism of an ink-jet recording apparatus according to a first modification of the present disclosure.

In a first modification, unlike the above-described embodiment, the containers 200 mounted to the mount unit 10 correspond on the one-to-one basis to the colors. The following description is given with reference to FIG. 6. Note that, the ink supply mechanisms for the different colors are the same as each other. Thus, for the sake of convenience, only an ink supply mechanism corresponding to one of the colors is shown in FIG. 6.

Note that, a basic configuration of the first modification is the same as that of the above-described embodiment. Thus, in the following description, components common to those of the above-described embodiment have the same names, and are denoted by the same reference symbols to omit redundant description.

In the first modification, the single container 200 that contains an ink in the corresponding color is connected to each of the sub tanks 20 via the supply tube 1. Other configuration features of the first modification are the same as those of the above-described embodiment.

In the first modification, as in the above-described embodiment, when the allowed state has already been established at the time point when the amount of the ink in the sub tank 20 (amount of the ink pooled in the sub tank 20) as detected on the basis of the output values from the pool sensor 23 becomes smaller than the appropriate pooled amount, the control unit 30 supplies the ink from the container 200 to the sub tank 20. Meanwhile, when the allowed state has not yet been established even at the time point when the amount of the ink in the sub tank 20 (amount of the ink pooled in the sub tank 20) as detected on the basis of the output values from the pool sensor 23 becomes smaller than the appropriate pooled amount, the control unit 30 does not supply the ink from the container 200 to the sub tank 20. With this, the same advantages as those of the above-described embodiment can be provided.

Note that, in the first modification, since the containers 200 corresponding on the one-to-one basis to the colors are mounted, the configuration can be more simplified than that of the above-described embodiment. Note that, in the print job in which the inks are consumed in a large amount within a short time period, when a container 200 corresponding to one color is emptied among the containers 200 while the print job is being performed, an ink in that one color is depleted. Thus, the container 200 corresponding to this color needs to be promptly replaced.

(Second Modification)

In a second modification, as in the above-described embodiment, the plurality of containers 200 that contain the ink in the same color are mounted to the mount unit 10.

Figure 7:
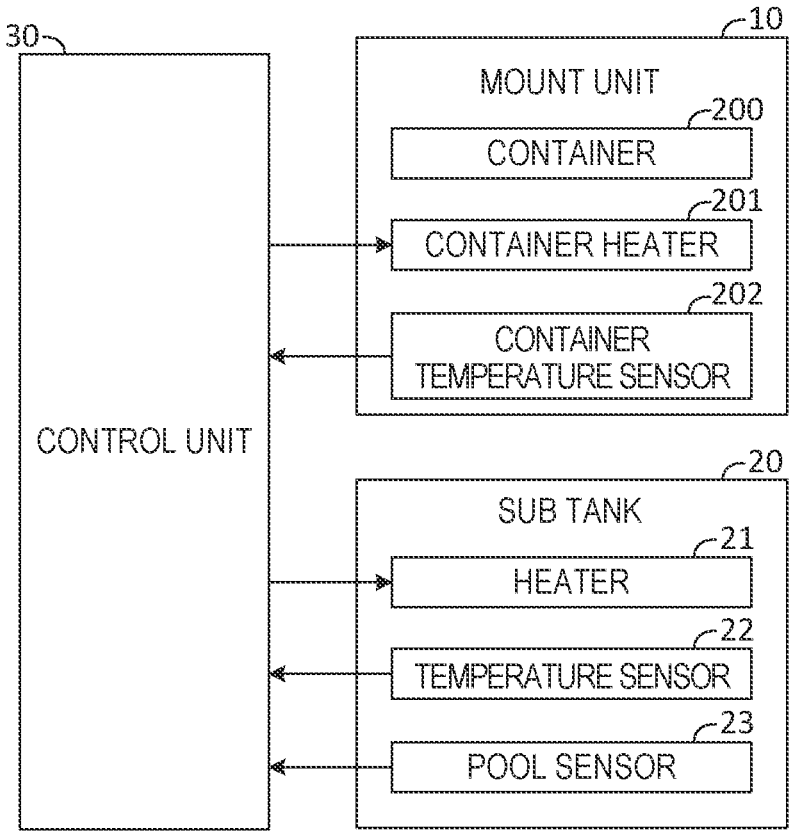
FIG. 7 is a block diagram relating to a temperature maintenance process executed in an ink-jet recording apparatus according to a second modification of the present disclosure.

In this configuration, as shown in FIG. 7, in the second modification, a container heater 201 for heating the container 200 is further provided. In addition, in the second modification, a container temperature sensor 202 for detecting a temperature of the container 200 is also further provided. Both the container heater 201 and the container temperature sensor 202 are assigned one each to each of the containers 200. Note that, for the sake of convenience, only the sub tank 20, the heater 21, and the temperature sensor 22 corresponding to one color are shown in FIG. 7. In addition, only the container 200, the container heater 201, and the container temperature sensor 202 corresponding to one color are shown in FIG. 7.

The container heater 201 heats the container 200 to maintain the temperature of the container 200 at a preset container-control temperature. The container temperature sensor 202 outputs values in accordance with the temperature of the container 200. Note that, by heating the container 200, the ink contained in the container 200 is heated. As the temperature of the container 200 becomes higher, a temperature of the ink contained in the container 200 becomes higher. As the temperature of the container 200 becomes lower, the temperature of the ink contained in the container 200 becomes lower. In other words, the container temperature sensor 202 outputs values in accordance with the temperature of the ink contained in the container 200.

The container control temperature is set to be equal, for example, to the tank control temperature. In other words, the container control temperature, the tank control temperature, and the head control temperature are equal to each other.

The control unit 30 controls and drives the container heater 201. Specifically, the control unit 30 controls ON/OFF of energization of the container heater 201. Further, the control unit 30 detects the temperature of the container 200 on the basis of the output values from the container temperature sensor 202.

Still further, in accordance with the temperature of the container 200, the control unit 30 switches whether or not to cause the container heater 201 to heat the container 200. In this way, the control unit 30 maintains the temperature of the container 200 at the container control temperature. In other words, the control unit 30 executes a temperature maintenance process with respect to the container 200. Note that, the control unit 30 executes the temperature maintenance process with respect to each of the containers 200.

By executing the temperature maintenance process with respect to the container 200, the temperature of the ink to be supplied from the container 200 can be suppressed from decreasing. With this, the temperatures of the ink to be supplied from the sub tank 20 to the recording head 40 can be maintained at a constant level. As a result, the reliability of suppressing the variation in temperature of the ink in the recording head 40 can be increased. In other words, a reliability of suppressing the ink injection failures that may occur if the ink to be supplied from the sub tank 20 to the recording head 40 is at a low temperature (has a highly viscosity) can be increased. With this, the image-quality degradation can be increased.

The control unit 30 controls the ink supply from the container 200 to the sub tank 20, for example, in either a first mode or a second mode. The control modes of the ink supply may be set, for example, by the user.

Under a state in which the first mode has been set as the control mode, when the temperature of the sub tank 20 is equal to or higher than the tank control temperature, the control unit 30 determines that the allowed state has been established. In addition, the control unit 30 performs the ink supply from the container 200 to the sub tank 20 under the state in which the allowed state has been established. In other words, in the first mode, the same control as that in the above-described embodiment is performed.

Under a state in which the second mode has been set as the control mode, when the temperature of the sub tank 20 is equal to or higher than the tank control temperature, and when the temperature of the container 200 is equal to or higher than the container control temperature, the control unit 30 determines that the allowed state has been established. In addition, the control unit 30 performs the ink supply from the container 200 to the sub tank 20 under the state in which the allowed state has been established.

In the second mode, the ink is not supplied at a temperature lower than the container control temperature (temperature that is equal to each of the tank control temperature and the head control temperature) from the container 200 to the sub tank 20. In other words, the temperature of the sub tank 20 (temperature of the ink pooled in the sub tank 20) can be reliably suppressed from decreasing.

Thus, in the configuration of the second modification, it is preferred to set the second mode in performing the print job in which the inks are consumed in a large amount within a short time period, that is, a print job in which the ink supply from the containers 200 to the sub tank 20 is repeated a number of times within the short time period.

All the embodiment and the modifications disclosed herein are merely examples, and hence should not be regarded as limitations. In addition, the scope of the present disclosure is defined not by the embodiment or the modifications described above but by the scope of claims, and encompasses meaning of equivalents of the elements described in the scope of claims and all modifications within the scope of claims.

What is claimed is:

1. An ink-jet recording apparatus to which a container that contains an ink is mounted, the ink-jet recording apparatus comprising:

a sub tank that pools the ink supplied from the container;

a recording head that ejects the ink supplied from the sub tank onto a sheet;

a heater that maintains a temperature of the sub tank at a preset tank-control temperature;

a temperature sensor that outputs a value in accordance with the temperature of the sub tank; and a control unit that determines whether or not an allowed state has been established, and that supplies the ink from the container to the sub tank when the allowed state has been established, the control unit detecting the temperature of the sub tank on a basis of the output value from the temperature sensor, the control unit determining that the allowed state has been established when the temperature of the sub tank is equal to or higher than the preset tank-control temperature, the sub tank having a capacity that is higher than a capacity per container.

2. The ink-jet recording apparatus according to claim 1, further comprising a pool sensor that varies an output value from the pool sensor when an amount of the ink in the sub tank becomes smaller than a preset appropriate pooled amount, wherein the control unit detects the amount of the ink in the sub tank on a basis of the output value from the pool sensor, and wherein the control unit supplies the ink from the container to the sub tank if the allowed state has already been established when the amount of the ink in the sub tank becomes smaller than the appropriate pooled amount, and refrains from supplying the ink from the container to the sub tank if the allowed state has still been unestablished even when the amount of the ink in the sub tank becomes smaller than the appropriate pooled amount.

3. The ink-jet recording apparatus according to claim 1 wherein the container mounted to the ink-jet recording apparatus includes a plurality of containers that contain the ink in a same color.

4. The ink-jet recording apparatus according to claim 3, wherein the control unit supplies, to the sub tank, the ink in a container that is set as a supply source among the plurality of containers that contain the ink in the same color, and wherein the control unit refrains from changing the supply source until the container as the supply source is emptied, and sets another container among the plurality of containers as a new supply source when the container as the supply source is emptied, the another container containing the ink in the same color as the ink in the emptied container as the supply source.

5. The ink-jet recording apparatus according to claim 1, further comprising a container heater that maintains a temperature of the container at a preset container-control temperature.

6. The ink-jet recording apparatus according to claim 5, further comprising a container temperature sensor that outputs a value in accordance with the temperature of the container, wherein the control unit detects the temperature of the container on a basis of the output value from the container temperature sensor, and wherein, when the temperature of the sub tank is equal to or higher than the preset tank-control temperature, and when the temperature of the container is equal to or higher than the preset container-control temperature, the control unit determines that the allowed state has been established.

* * * * *